US010828525B2

(12) United States Patent
Dinkins

(10) Patent No.: US 10,828,525 B2
(45) Date of Patent: Nov. 10, 2020

(54) COLLAPSIBLE HAND EXERCISE ASSEMBLY

(71) Applicant: Jason Dinkins, Tinley Park, IL (US)

(72) Inventor: Jason Dinkins, Tinley Park, IL (US)

( * ) Notice: Subject to any disclaimer, the term of this patent is extended or adjusted under 35 U.S.C. 154(b) by 76 days.

(21) Appl. No.: 15/408,028

(22) Filed: Jan. 17, 2017

(65) Prior Publication Data

US 2018/0200556 A1 Jul. 19, 2018

(51) Int. Cl.

| | |
|---|---|
| ***A63B 21/04*** | (2006.01) |
| ***A63B 23/16*** | (2006.01) |
| ***A63B 21/00*** | (2006.01) |
| ***A63B 71/02*** | (2006.01) |

(52) U.S. Cl.

CPC ..... *A63B 21/0414* (2013.01); *A63B 21/4023* (2015.10); *A63B 23/16* (2013.01); *A63B 2071/026* (2013.01); *A63B 2209/00* (2013.01); *A63B 2210/58* (2013.01); *A63B 2225/093* (2013.01)

(58) Field of Classification Search

CPC .... A63B 21/02–0557; A63B 23/08–10; A63B 23/16

See application file for complete search history.

(56) References Cited

U.S. PATENT DOCUMENTS

| | | | | |
|---|---|---|---|---|
| 1,472,906 | A * | 11/1923 | Gorrell | A63B 23/16 482/48 |
| 3,606,316 | A * | 9/1971 | Krewer | A63B 23/16 482/47 |
| 4,220,327 | A * | 9/1980 | Herbowy | A63B 23/16 482/44 |
| 4,337,939 | A * | 7/1982 | Hoyle | A63B 21/4047 482/79 |
| 5,556,359 | A * | 9/1996 | Clementi | A63B 23/16 482/123 |
| 5,738,613 | A * | 4/1998 | Clayton | A63B 21/154 482/100 |
| 6,036,621 | A * | 3/2000 | Hancock | A63B 23/16 482/121 |
| 6,213,918 | B1 * | 4/2001 | Rogers, Jr. | A63B 21/0004 482/124 |
| 6,280,361 | B1 * | 8/2001 | Harvey | A63B 21/025 482/101 |
| 7,887,471 | B2 * | 2/2011 | McSorley | A63B 21/0552 482/136 |
| 7,935,026 | B2 * | 5/2011 | McSorley | A63B 23/16 482/44 |
| 10,029,146 | B2 * | 7/2018 | Christoforou | A63B 23/16 |
| 2014/0057758 | A1 * | 2/2014 | Mack | A63B 21/0414 482/79 |

* cited by examiner

*Primary Examiner* — Jennifer Robertson
(74) *Attorney, Agent, or Firm* — Benjamin D. Rotman; Rosenbaum IP, P.C.

(57) ABSTRACT

A collapsible hand exercise assembly is disclosed. The frame comprises a substantially rectangular box having a plurality of panels to define a hollow upper section and the box is removably attached to a hollow vertical member via a fastening mechanism. The hollow vertical member is fixedly attached to a weighted base section of the frame. The hollow section comprises a plurality of resilient members tensioned to the sidewalls of the rectangular box is configured to provide resistance for muscles when a user performs the hand exercise.

17 Claims, 4 Drawing Sheets

COLLAPSIBLE HAND EXERCISE ASSEMBLY

FIELD OF THE INVENTION

The present invention relates to an exercise assembly and more particularly relates to the exercise assembly for use in strengthening and therapy of the muscles in the forearm, wrist, and fingers and providing rehabilitation to soft tissues and reduces elbow pain.

BACKGROUND OF THE INVENTION

The human hand is made up of muscles, nerves and bones that work in synergy to help the user to pick up, push and pull various things. In order to make a stronger grip in the hand, people used to increase strength by doing wrist exercises and some specific exercises that target the gripping muscles of the hand and forearm. Available products in the market such as mechanical hand grips are inexpensive training devices that isolate the muscles that are important for gripping strength Existing hand exercisers are used for rehabilitating the soft tissue such as cartilage, ligaments, tendons, nerves but these hand exercisers have fallen short in many aspects.

During the hand exercise, the muscles are brought into operation in the forearm, hand, wrist and fingers as a result of contraction of the hand against the resistance of the hand held devices. This resistance is generally offered by many devices such as springs, rubber balls to be gripped by the hand, readily available devices in the market such as Thera-Band, Cando, Handmaster, and Dynaflex are intended to accommodate the fingers but are generally limited to a single range of movement as the devices are forced to contract. The hand movement is limited and therefore the benefits are very minimal.

In this modern generation, the workplace is filled with computers where the users need to spend hours using the keyboard resulting in painful stress in both the hand and the wrist. Many people having consistent pain are diagnosed with carpal tunnel syndrome which occurs when their wrists are exposed to persistent and repetitive strain, causing the tissue surrounding the tendons to become so enlarged that they compress the median nerve which runs through the carpal tunnel, a passage in the wrist. Severe medical attention is required for the treatment carpal tunnel syndrome if the condition of the patient becomes severe.

Various hand grip exercise exists for the treatment of carpal tunnel syndrome. Many of these exercises are performed using different types of exercise equipment and require more time and attention from the user.

Prior art reference U.S. Pat. No. 7,121,983 discloses a method and apparatus for hand exercising. The patent further discloses a stretchable web, with an array of spaced apertures molded over a rigid frame. However, the varying degree of resistance is limited 20 degrees to 80 degrees due to the material used to form the hand exerciser.

The present invention addresses these issues by providing a hand exerciser wherein a resilient material with different elasticity modulus is configured to provide wide range of resistance levels to reduce the muscle pain.

SUMMARY

According to one aspect of the present invention, a collapsible hand exercise assembly is disclosed. The frame comprises a substantially rectangular box having a plurality of removeable panels to define a hollow upper section wherein the box is removably attached to a hollow vertical member via a fastening mechanism. The hollow vertical member is fixedly attached to a weighted base section of the frame. The hollow upper section comprises a plurality of resilient members tensioned to the sidewalls of the rectangular box is configured to provide resistance for muscles when a user performs the hand exercise.

In accordance with another aspect of the present invention, the rectangular box has resilient members, wherein resilient members are made of rubber, with different resistance levels.

In accordance with another aspect of the present invention, the hollow vertical member height is selectively adjustable. Depending on the user requirements, the height of the vertical member can be changed. The hand exercises performed by the user reduces the pain of carpal tunnel and elbow pain. The collapsible hand exercise assembly helps the user in increasing the hand grip by continual practice.

In accordance with another aspect of the present invention, a method for hand exercising using a collapsible hand exercise assembly is disclosed. The method comprises the steps of providing a frame having a substantially rectangular box having a plurality of panels to define a hollow upper section. Removably attaching a hollow vertical member via a fastening mechanism. Fixedly attaching the hollow vertical member to a weighted base section of the frame and configuring the hollow section of the rectangular box with a plurality of resilient members tensioned to the sidewalls of the box to provide resistance for muscles when a user performs the hand exercise.

Other objects and advantages of the invention will appear from the following detailed description of the preferred embodiment of the invention with reference being made to the accompanying drawings.

DETAILED DESCRIPTION OF THE INVENTION

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
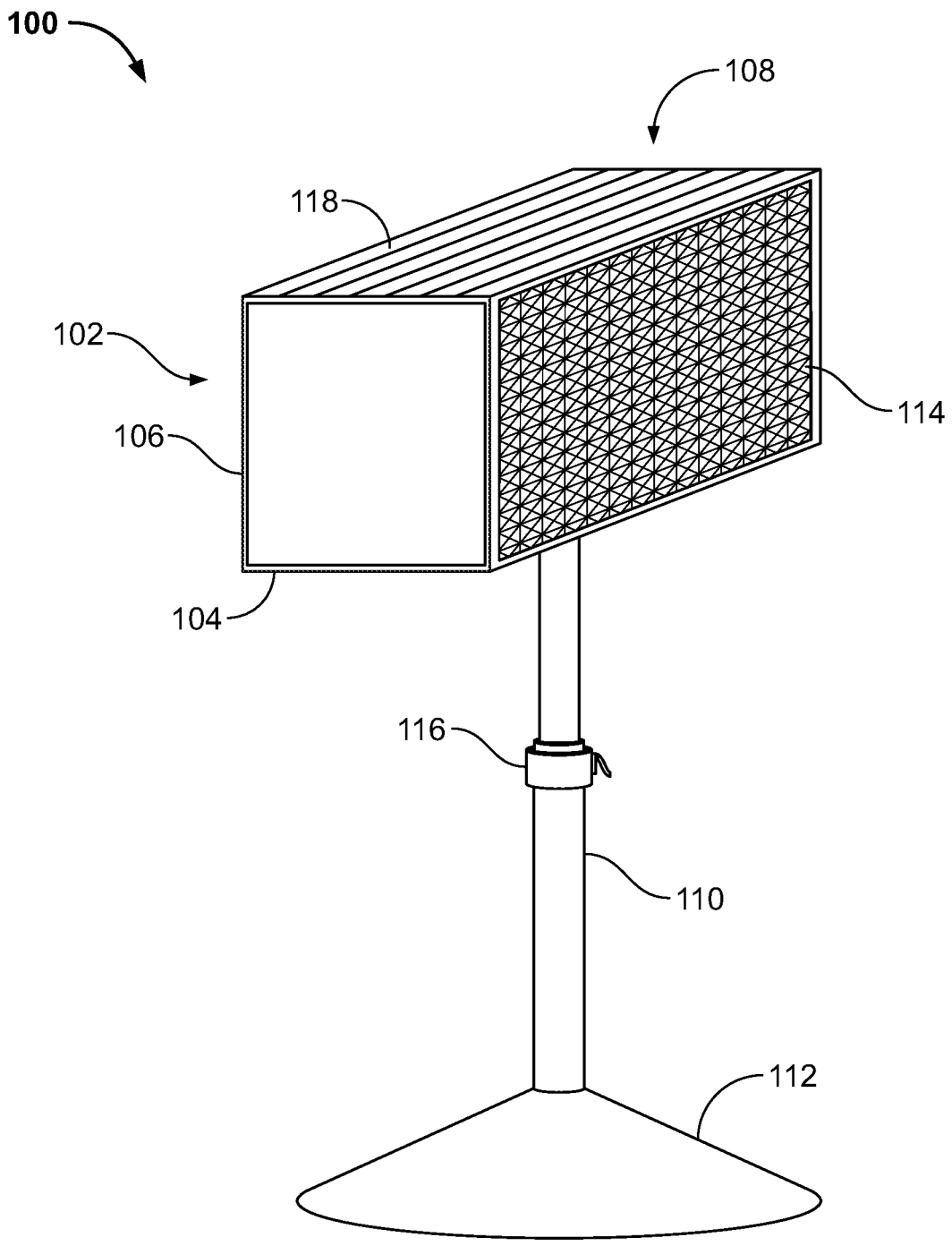
FIG. 1 is a perspective view of a collapsible hand exercise assembly of the present invention.
Figure 3:
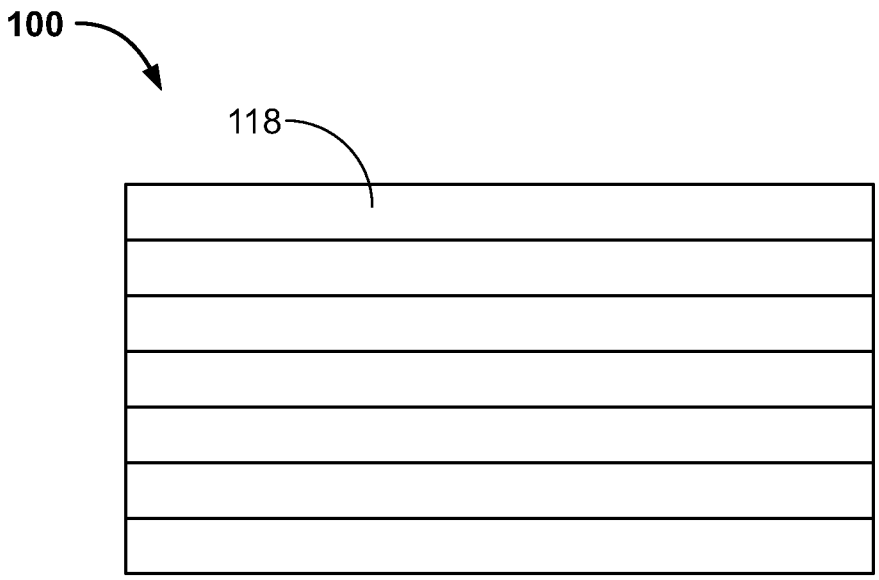
FIG. 3 is a top view of a rectangular box of the collapsible hand exercise assembly of the present invention.

According to the FIG. 1, which illustrates a collapsible hand exercise assembly 100 for multi-movement exercising of the muscles of the forearm, hand, wrist and fingers. The collapsible hand exercise assembly 100 comprises a frame 102 made up of rigid material. Preferably, other suitably strong and rigid materials could be used. The frame 102 comprises a substantially rectangular box 104 having a plurality of sidewalls 106 to define a hollow section 108. The substantially rectangular box 104 is removably attached to a hollow vertical member 110 via a fastening mechanism. The hollow vertical member 110 is fixedly attached to a weighted base section 112 of the frame 102. The hollow vertical member 110 having a telescoping adjustment 116 to adjust the height of the hollow vertical member 110 between 3 feet to 6 feet. The hollow section 108 is configured to position a plurality of panels 118 comprising the resilient members 114 tensioned to the sidewalls 106 of the substantially rectangular box 104 is configured to provide resistance for muscles when a user performs the hand exercise. The substantially rectangular box 104 has a border and the top portion of the rectangular box 104 is not covered for the purpose of resilient members 114 to slide in, as shown in FIG. 3. The embodiments disclosed herein rely on friction to create a resistance that may be used to strengthen the wrists and/or forearms of a user.

According to the preferred embodiment of FIG. 1, the resilient members 114 can be a elastic band made from the materials selected from the group of rubber, silicon, silicon-based rubber, latex, and combinations thereof. The resilient member 114 of a preferred embodiment is made from a rubber latex material. However, an embodiment of the present invention may be made from any polyethylene, nylon, or any suitable combination thereof, for example. The resilient members 114 are tensioned inside the hollow upper section 108 to assist the user in alleviating the carpal tunnel pain and elbow pain. The hollow upper section 108 depth is about 2.5 inches to about 9 inches. The hollow upper section 108 length is preferably about eighteen inches. The hollow upper section 108 breadth is about eight inches. Based on user's age and other requirements, the configuration such as length, breadth and depth can be varied accordingly. Since the resilient members 114 formed in the back and forth arrangement, the hand exerciser assembly is suitable for reducing the elbow pain and can also be used to treat carpel tunnel syndrome. The collapsible hand exercise assembly 100 is inexpensive and allows the user to perform a wide variety of muscle movement according to direction of extending and stressing the fingers. There is no restriction for the user muscle extension movement which results in high resistance. The collapsible hand exercise assembly 100 does not slip due to sweat or moisture for the user while doing the exercise.

Figure 2:
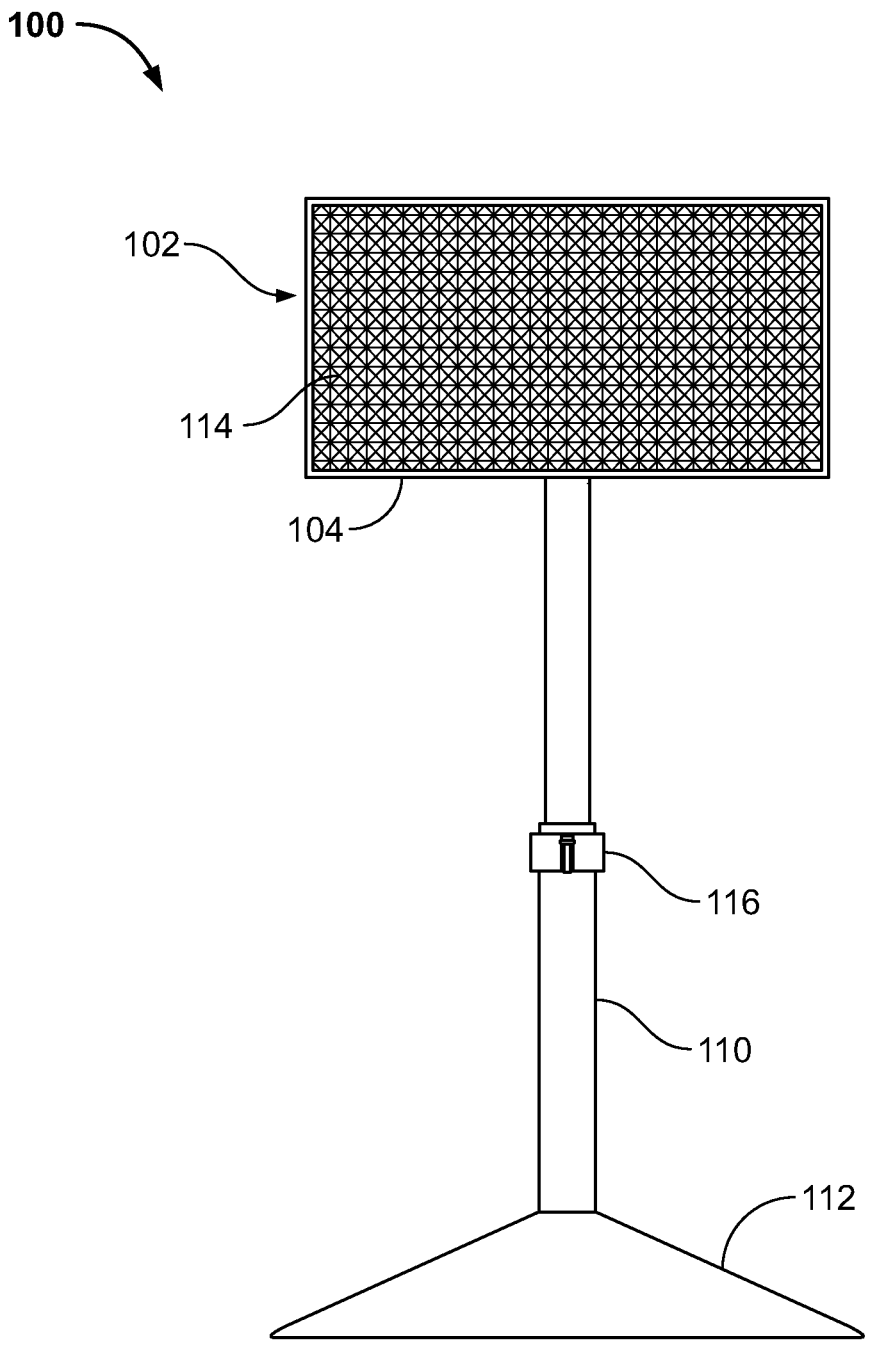
FIG. 2 is a side view of the collapsible hand exercise assembly of the present invention.
Figure 4:
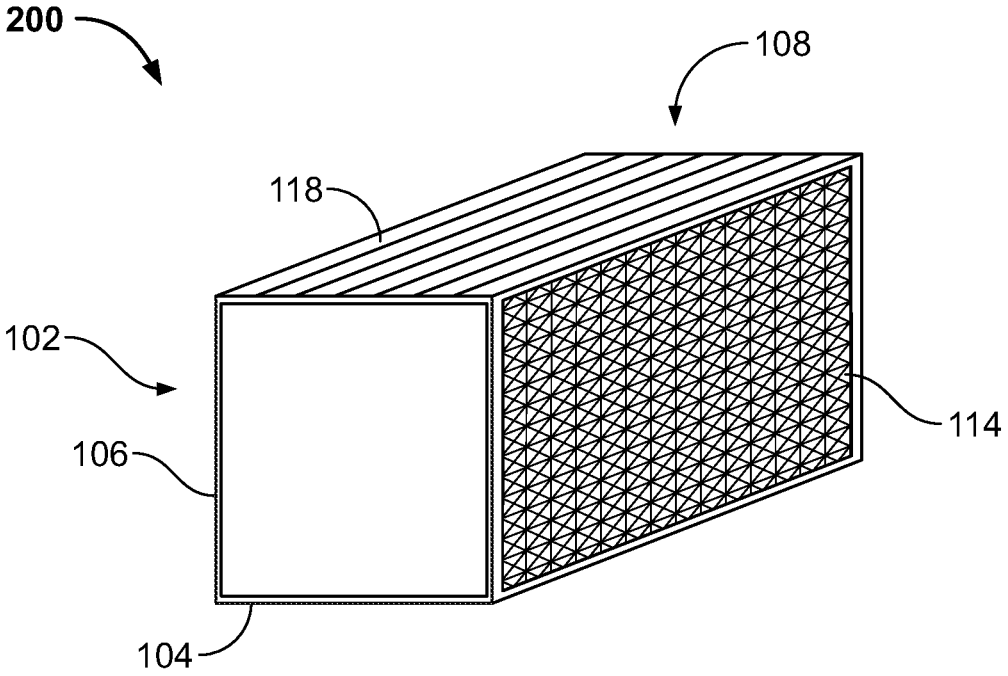
FIG. 4 is a plan of the rectangular box removed from the collapsible hand exercise assembly of the present invention.

According to FIG. 2, is a side view of the collapsible hand exercise assembly of the present invention. The frame 102 having the top portion of the substantially rectangular box 104 is about 9 inches in length. The telescoping member 116 may be provided with the fastening mechanism. The length of hollow vertical member 110 is adjusted by depressing the fastening mechanism and the telescoping member 116 slide with respect to hollow vertical member 110. When the desired length is achieved, fastening mechanism will be received in the desired position representing the desired length to lock the telescoping member 116 to adjust for variable heights. The resilient members 114 are configured to take a diamond shape as shown in FIG. 2. However, other configurations (not shown) such as triangular, rectangular, hexagonal, diagonal, vertical, horizontal or any geometric shape can be used with sound engineering judgment. When the user inserts and maneuvers their fingers inside the resilient members 114, the user can experience a certain degree of resistance. The amount of resistance is proportional to the size and shape of the resilient members 114 in relation to the size of the user's fingers. User can also roll forward or backward with constant resistance. The resilient members 114 comprise a plurality of individual segments, wherein each segment is made from a similar material configured to provide similar resistance levels. In a preferred embodiment, the elastic bands have different elasticity modulus to provide various resistance levels to the user. The resilient members 114 can also be color coded based on different levels of resistance. Different color denotes different levels such as extra light, light, medium, heavy and maximum. The size and dimensions of the sidewalls 106 and resilient members 114 of the frame 102 can be varied based on the user requirements. The horizontal lines represent the resilient members 114 which slide into the top of the substantially rectangular box 104. The resilient members 114 are configured to run in all directions. In a preferred embodiment, resilient members 114 are removable to clean, and the tension of the resilient members could be changed for effective training According to FIG. 3, shows a top view of a rectangular box of the collapsible hand exercise assembly of the present invention. The top portion of the substantially rectangular box 104 having plurality of panels 118. The substantially rectangular box 104 can have 6 to 8 panel 118. Each panel 118 is one inch thickness in which the resilient members 114 run in all directions. In a preferred embodiment the collapsible hand exercise assembly 100 is 18 inch length. The breadth of the hollow section is about 8 inches. The depth of the hollow section is about 2.5 inches to about 9 inches According to FIG. 4, shows the top view of the rectangular box 104 removed from the collapsible hand exercise assembly 100. The rectangular box 104 is removably attached to a hollow vertical member 110 via a fastening mechanism. The fastening mechanism can be external threaded element between the hollow vertical member 110 and the rectangular box 104. It is also foreseen that the rectangular box 104 could be made adjustable without the use of fasteners as such. For example, a detent mechanism (not shown) could be engaged between the hollow vertical member 110 and the rectangular box 104. The removable rectangular box 104 can be detached from the collapsible hand exercise assembly 100 based on the requirement of the user. The panels 118 slide into the top portion of the collapsible hand exercise assembly 100. The panels 118 comprising the resilient members 114 configured to be present in side wall 106 of the hollow section 108. The collapsible hand exercise assembly 100 is portable and can be used in any locations such as office, gym, home, public arena, etc. The hollow vertical member 110 comprises a telescopic member configured to be adjusted for different height settings. Users can perform the hand exercises in different postures, for example, sitting in the flat surface or floor. When the user is stationary, he or she can roll the fingers inside the resilient members 114 tensioned to the sidewalls 106 of the rectangular box 104 and can sense the burn feel which in turn increases the resistance. In order to utilize collapsible hand exercise assembly 100 of the present invention, the user fingers are inserted into the resilient members 114. The collapsible hand exerciser 100 is handy in usage such that it can separate easily and be moved to any place and occupies very little space. Resistance levels generally vary based upon the user age and muscle fitness. The user can specify hand and arm muscles in various maneuvering ways to strengthen the key muscles in the hand and forearm. By using one or more fingers, it is possible to contract resilient members 114 in various ways in carrying out scissor movements, curling and related motions. Maneuvering and squeezing the user's fingers in the resilient members 114 helps to touch the user finger tips, thus providing resistance to the muscles. People suffering from the carpel tunnel syndrome can use this collapsible hand exercise assembly 100 for better movement of the muscles. The resistance yielded in opposite direction than normal direction makes the user finger tip work so that elbow pain and numbness can be reduced gradually. The gripping strength of the complete forearm and hand muscles is increased by using this collapsible hand exercise assembly 100.

According to another preferred embodiment of FIG. 1, the collapsible hand exercise assembly 100 provides assistance for sufferers of back pain and rheumatism and may be used in physiotherapy in hospitals and clinics. It may also be used for exercising or training persons who regularly visits gyms for getting special strength training for hand, forearm, wrist and fingers. The collapsible hand exercise assembly 100 replaces the traditional sand bucket in the gym and provides special benefit to persons who play sports activities where they have to use their hand and forearm most of the time. The collapsible hand exercise assembly 100 can be useful for massage therapist, people using keyboards, electrician and athletes. Many variations and combinations of the exercises can be carried out using the collapsible hand exercise assembly 100.

At least one embodiment been described, hereinabove. It will be apparent to those skilled in the art that the above methods may incorporate changes and modifications without departing from the general scope of this invention. It is intended to include all such modifications and alterations in so far as they come within the scope of the appended claims or the equivalents thereof.

The invention claimed is:

1. A collapsible hand exercise assembly comprising:

a hollow frame comprising a substantially rectangular box having a plurality of removable panels coupled thereto, wherein the box is removably coupled to a hollow vertical member;

wherein the hollow vertical member is fixedly attached to a weighted base section of the frame, and wherein a plurality of resilient members are tensioned to the plurality of panels and are configured to provide resistance for muscles when a user performs the hand exercise.

2. The apparatus of claim 1, wherein the each resilient member comprises a plurality of individual segments, wherein each segment is made from the same material configured to provide substantially equal resistance levels.

3. The apparatus of claim 1, wherein the frame is made of a substantially rigid material.

4. The apparatus of claim 1, wherein a depth of the box is about 2.5 inches to about 9 inches.

5. The apparatus of claim 1, wherein a length of the box is about 18 inches.

6. The apparatus of claim 1, wherein a breadth of the box is about 8 inches.

7. The apparatus of claim 1, wherein the hollow vertical member comprises a telescopic member configured to be adjusted for different height settings.

8. The apparatus of claim 1, wherein the resilient members are made from materials selected from the group of rubber, silicon, silicon-based rubber, latex, plastic and combinations thereof.

9. A method for hand exercising using a collapsible hand exercise assembly, the method comprising the steps of:

providing a collapsible hand exercise assembly comprising:

a hollow frame comprising a substantially rectangular box having a plurality of panels disposed within the hollow frame and coupled to the hollow frame, further the plurality of panels comprising a plurality of resilient members tensioned with each panel;

coupling the box to a vertical member;

coupling the vertical member to a weighted base section;

configuring the hollow frame with the plurality of panels to provide resistance for muscles when a user performs the hand exercise; and a user inserting a user hand into the hollow frame and grasping the plurality of resilient tensioned members and releasing the plurality of resilient tensioned members.

10. A collapsible hand exercise assembly comprising:

a hollow frame member;

at least one panel disposed within the hollow frame member, the at least one panel removably coupled to the hollow frame member;

the at least one panel comprising a plurality of resilient members tensioned throughout the at least one panel providing a plurality of finger openings between each resilient member; and wherein the plurality of resilient members are configured to provide resistance for muscles when a user performs the hand exercise.

11. The collapsible hand exercise assembly of claim 10 wherein the hollow frame member is removably coupled to a vertical member and the vertical member is coupled to a weighted base.

12. The collapsible hand exercise assembly of claim 11, wherein the vertical member comprises a telescopic member configured to be adjusted for different height settings.

13. The collapsible hand exercise assembly of claim 10, wherein the resilient members are made from materials selected from the group of rubber, silicon, silicon-based rubber, latex, plastic and combinations thereof.

14. The collapsible hand exercise assembly of claim 10 wherein the hollow frame member comprises a plurality of panels.

15. The collapsible hand exercise assembly of claim 14 wherein each panel of the plurality of panels comprises either a different pattern of the plurality of resilient members or a different resistance value for the plurality of resilient members.

16. The collapsible hand exercise assembly of claim 10 wherein the hollow frame member is substantially a rectangular box.

17. The apparatus of claim 14, wherein at least one panel of the plurality of panels has a plurality of resilient members of a different material or different resistance than at least a second panel of the plurality of panels.

* * * * *